United States Patent [19]

Shimoishi et al.

[11] Patent Number: 4,795,286

[45] Date of Patent: Jan. 3, 1989

[54] PEN TIP STRUCTURE

[75] Inventors: Tetsuo Shimoishi; Yasuhiro Aoki, both of Shizuoka; Katsumi Otsuka, Chiba, all of Japan

[73] Assignee: Teibow Co., Ltd., Shizuoka, Japan

[21] Appl. No.: 823,497

[22] PCT Filed: Oct. 17, 1985

[86] PCT No.: PCT/JP85/00577

§ 371 Date: Jan. 24, 1986

§ 102(e) Date: Jan. 24, 1986

[87] PCT Pub. No.: WO87/02312

PCT Pub. Date: Apr. 23, 1987

[51] Int. Cl.[4] ..... B43K 7/10

[52] U.S. Cl. ..... 401/209; 401/216; 401/284

[58] Field of Search ..... 401/209, 216, 198, 199, 401/284

[56] References Cited

U.S. PATENT DOCUMENTS

| | | | |
|---|---|---|---|
| 566,558 | 8/1896 | Bell | 401/284 |
| 2,551,490 | 5/1951 | Ferst et al. | 401/216 |
| 3,537,801 | 11/1970 | Corte | 401/216 |
| 3,781,123 | 12/1973 | Linz et al. | 401/216 |
| 3,904,297 | 9/1975 | Hori | 401/216 |
| 4,384,800 | 5/1983 | Dyama | 401/216 |
| 4,529,329 | 7/1985 | Hirabayashi et al. | 401/209 |

FOREIGN PATENT DOCUMENTS

| | | | |
|---|---|---|---|
| 422306 | 6/1947 | Italy | 401/209 |

*Primary Examiner*—Richard J. Apley
*Assistant Examiner*—Franklin L. Gubernick
*Attorney, Agent, or Firm*—Watson, Cole, Grindle & Watson

[57] ABSTRACT

A pen tip structure comprises (1) an elongated stem which defines a cylindrical outer surface and a flat end surface, the flat end surface including one or more grooves which extend from the cylindrical outer surface radially inwardly towards a center point thereof, (2) a tube positioned around the elongated stem, the tube including inwardly-extending protrusions that form at least one longitudinal ink flow channel along the cylindrical outer surface of the elongated stem, and an end portion which is located beyond the flat end surface of the elongated stem, the end portion providing a mouth, and (3) a rotatable member positioned between the noted mouth and the flat end surface of the elongated stem, the rotatable member having a surface portion which extends beyond the mouth for conveying ink to a receiving surface and an opposite surface portion for receiving ink supplied thereto by capillary action. The longitudinal ink flow channel(s) supply ink to the groove(s) in the flat end surface of the elongated stem, the ink being reliably supplied to the surface of the rotatable member under all writing conditions by capillary action.

16 Claims, 9 Drawing Sheets

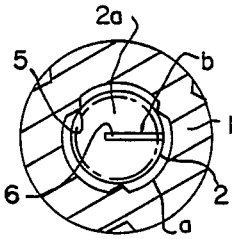
FIG. 2
FIG. 1
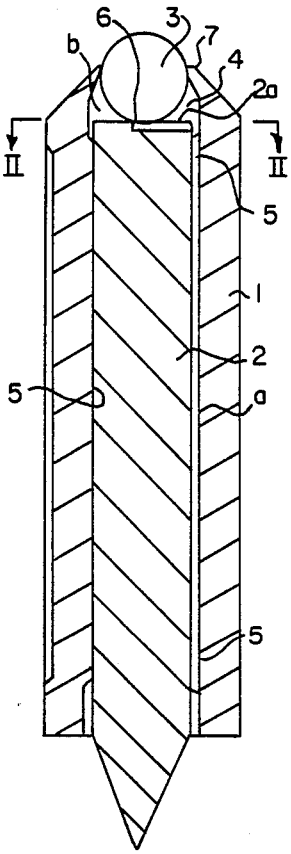
FIG. 3
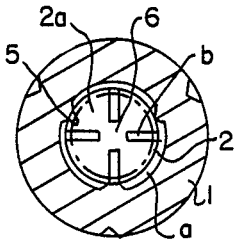

PEN TIP STRUCTURE

TECHNICAL FIELD

The present invention relates to a pen tip structure characterized in that a ball retaining portion thereof and an ink flow space conducting the ink to the ball retaining portion can be simply structured just by assembling two members into one unit, resistance to rotation of the ball within the ball retaining portion during the writing operation is low, and, while the ink is transmitted by capillary action from the ink flow space to ink flow paths on the end surface portion of a ball receiving stem, i.e., into the ball retaining portion, extraction of the ink by the ball is smoothly carried out within this ball retaining portion, and provides good productivity in the manufacture and proper functioning in writing, suited for various applications such as for writing, drawing, and toilet purposes, and chiefly made of the same kind of metallic material.

BACKGROUND ART

Ballpoint pens are well known as writing instruments and utilize a ball in the pen tip portion which rotates due to frictional force created in the writing motion to deposit ink on the writing surface. The pen tip structure of the ballpoint pen comprises a ball retaining shaft and a ball rotatably received in the ball retaining portion of the ball retaining shaft. The bottom of the ball retaining portion of the ball retaining shaft is formed into a cone-shape and an ink flow hole is bored in the center of the cone-shaped bottom.

There are problems in connection with the manufacture and writing performance and electrostatic action a ballpoint pens as follows.

PROBLEMS IN MANUFACTURE

When the ball retaining shaft is made of metal, the ball retaining portion and the ink flow hole are manufactured by machining or forming, thus requiring high precision machining. When the ball retaining shaft is made of plastic, high precision forming dies are required.

PROBLEMS IN WRITING

Due to the fact that the bottom of the ball retaining portion for operably holding the ball for rotation under writing pressure is cone-shaped, such that the ball receives resistance to its rotation by wedging action, the ball is hindered from rotating smoothly and the extraction of the ink by the ball becomes unsteady. As a result, intermittence in the written line occurs, which means that such a ballpoint pen is not suitable for speed writing.

PROBLEMS DUE TO ELECTROSTATIC ACTION

When the pen tip is formed of a combination of different metals, e.g., when the ball retaining shaft is made of brass and the ball is made of a hard steel, corrosion due to the potential difference between the metals produces rust and the rust clogs the ink flow path, preventing smooth flow of the ink.

Accordingly, the present invention has as its primary object the provision of a pen tip structure which is free from the above stated problems encountered in the prior art, which is easy to manufacture, which allows the ball to rotate and extract the ink smoothly, and which is suited for speed writing.

Another object of the invention is the provision of a pen tip structure in which the ink flow path is formed of a plurality of paths communicating with each other at the center of the end surface portion of the ball receiving stem, whereby the entire region the ink is conducted thereinto on the bottom of the ball retaining portion including the portion with which the ball rubs is improved.

A further object of the invention is the provision of a pen tip structure in which the ink flow path is disposed from an end of the ink flow space to the center of the end surface portion of the ball receiving stem, whereby the region the ink is conducted thereinto at the bottom of the ball retaining portion with which the ball rubs is improved.

Still another object of the invention is the provision of a pen tip structure in which the ink flow path is disposed from an end of the ink flow space to the vicinity of the ball receiving surface portion in the center of the end surface portion of the ball receiving stem, whereby the strength of the ball receiving portion against which the ball rubs is improved.

A still further object of the invention is the provision of a pen tip structure in which the ink flow paths are arranged to communicate with each other in the vicinity of the ball receiving surface portion so as to surround the ball receiving surface portion, whereby strength of the ball receiving surface portion is improved and the region the ink is guided thereinto surrounding the ball receiving surface portion is improved.

An additional object of the invention is the provision of a pen tip structure in which the inner diameter of the ball retaining tube is made larger than the diameter of the ball at the portion where the ink flow space is formed, whereby the quantity of ink conduction by the ink flow space in comparison with the quantity of ink extraction by the ball is improved.

Another object of the invention is the provision of a pen tip structure in which the inner diameter of the ball retaining tube is arranged to be substantially the same as the diameter of the ball as far as where the ink flow space is disposed except its drawn portion for preventing the ball from getting out of place, whereby the pen tip having similar diameter to that of the ball is improved.

A further object of the invention is the provision of a pen tip structure in which the cross-sectional shape of the inner surface of the ball retaining tube and the cross-sectional profile of the ball receiving stem are made similar to each other, whereby ink conducting functioning in each position in the ink flow space is improved.

Another object of the invention is the provision of a pen tip structure in which the cross-sectional shape of the inner surface of the ball retaining tube and the cross-sectional profile of the ball receiving stem are similarly circular, whereby stability of ink conducting functioning in the ink flow space is improved.

A further object of the invention is the provision of a pen tip structure in which the cross-sectional shape of the inner surface of the ball retaining tube and the cross-sectional profile of the ball receiving stem are similarly square, whereby bending strength of the pen tip is improved.

Another object of the invention is the provision of a pen tip structure in which the cross-sectional shape of the inner surface of the ball retaining tube and the cross-sectional profile of the ball receiving stem are different from each other, whereby formability of the ink flow space is improved.

A further object of the invention is the provision of a pen tip structure in which the cross-sectional shape of the inner surface of the ball retaining tube is circular and the cross-sectional profile of the ball receiving stem is square, whereby formability of the ink flow space and ink conducting functioning in the same and bending strength of the pen tip are improved.

Another object of the invention is the provision of a pen tip structure in which the cross-sectional shape of the inner surface of the ball retaining tube is square and the cross-sectional profile of the ball receiving stem is circular, whereby formability of the ink flow space and bending strength of the pen tip are improved.

A further object of the invention is the provision of a pen tip structure in which the ball receiving stem is provided with a spiral groove portion axially disposed along its periphery where the ink flow space is formed, whereby ink conducting performance for low-viscosity ink is improved.

Another object of the invention is the provision of a pen tip structure in which the ball receiving stem is provided with concaved portions axially disposed along its periphery where the ink flow space is formed, whereby ink conducting performance for high-viscosity ink is improved.

A further object of the invention is the provision of a pen tip structure in which the caulked portion is formed into protruded stripes running in the axial direction, whereby the bending strength of the pen tip and ink conducting functioning in the axial direction in the ink flow space are improved.

Another object of the invention is the provision of a pen tip structure in which the caulked portion is formed into a drawn or constricted shape running in the circumferential direction, whereby the ink conducting functioning in the circumferential direction in the ink flow space is improved.

A further object of the invention is the provision of a pen tip structure in which the ball is spherical, whereby the pen tip is improved in its capability of changing directions and turning a corner in writing and in its versatility.

Another object of the invention is the provision of a pen tip structure in which the ball is made into a roller form, whereby the pen tip is improved in writing straight and drawing a line of a constant width.

A further object of the invention is the provision of a pen tip structure in which the ball retaining tube, ball receiving stem, and ball are made of stainless steel and the ball are chiefly made of the same material having high hardness, whereby the pen tip is improved in its durability against electrostatic action.

Another object of the invention is the provision of a pen tip structure in which the ball retaining tube, the stem portion of the ball receiving stem, and the ball are chiefly made of the same material having high hardness, and the stem portion is provided with a synthetic resin film applied to its peripheral surface, whereby the pen tip is improved in its durability against electrostatic action and in its wettability with the ink.

A further object of the invention is the provision of a pen tip structure in which the gap of the ink flow space where capillarity takes place is provided with approximately 25–100$\mu$ of thickness, whereby the ink conducting functioning in the ink flow space is enhanced.

Another object of the invention is the provision of a pen tip structure in which the ink flow path is of the size of approximately 25–110$\mu$ in width of its groove and approximately 100–20$\mu$ in depth of the same, whereby the ink conducting performance of the ink flow path is enhanced.

SUMMARY OF THE INVENTION

Thus the structure of a pen tip according to the invention is such that a ball retaining tube including therein a ball receiving stem is caulked and pressed thereto leaving an ink flow space running in the axial direction therebetween, a ball retaining portion is formed within the ball retaining tube at its end with the flat end surface portion of the bell receiving stem serving as the bottom thereof, and an ink flow path is formed along the end surface portion in communication with the ink flow space. This provides the following advantages.

1. The ball retaining portion and ink flow space are simply formed just by combining the ball retaining tube and ball receiving stem, and, at the same time, the ink flow path on the end surface portion of the ball receiving stem is interposed between the ink flow space and inside the ball retaining portion to complete the ink conducting path. Thus, the ball retaining portion and ink conducting path, the heart of the pen tip, are acquired economically.

2. The problem due to wedging action of the ball getting into the ball receiving surface portion is solved and smooth rotation of the ball is always assured.

3. The ink flow space is provided by the largest possible capillarity region obtainable within a limited range in the cross section of the pen tip.

4. The ink is transferred from the secured ink flow space through the ink flow path on the bottom of the ball retaining portion and extracted by the smoothly rotating ball in a quantity necessary and sufficient. The problem of insufficient ink extraction by the ball is solved and steady ink drawing is assured and therefore there is no intermittence in a written line.

And the invention provides in the above described improved pen tip structure the ink flow path extended from the ink flow space to the center of the end surface portion of the ball receiving stem. This provides the following advantages.

5. The drawing of the ink is performed in proper quantities by the ball in the region on the bottom of the ball retaining portion into which the ink is fed by capillarity, that is, the ball receiving surface portion with which the ball rubs, the rotation of the ball lubricated by the ink is thus secured.

And the invention provides in the above described improved pen tip structure the ink flow path in a plurality of ink flow paths communicating with each other at the center of the end surface portion of the ball receiving stem. This provides the following merit.

6. Supply of the ink from the ink flow space to make up for the drawn ink by the ball is secured to the degree necessary and sufficient by the regions in which capillarity takes place communicating with each other on the entire bottom surface of the ball retaining portion including the ball receiving surface portion with which the ball rubs.

And the present invention provides in the above described improved pen tip structure the ink flow path extended from one end of the ink flow space to the vicinity of the ball receiving surface portion in the center of the end surface portion of the ball receiving stem. This provides the following merit.

7. The structure endures impulsive writing-pressure and high writing-pressure through the high strength of the flat bell receiving surface portion making the structure also suited for such as the printing element in a printer.

And the invention provides in the above described improved pen tip structure the ink flow paths in communication with each other surrounding the ball receiving surface portion in the vicinity of the ball receiving surface portion. This provides the following merits.

8. The structure exhibits good durability against impulsive writing-pressure and high writing pressure and keeps the quantities of the ink drawn by the ball uniform and steady in all directions in which the rotating ball advances.

And the present invention provides in the above described improved pen tip structure the outer diameter of the ball receiving stem larger than the diameter of the ball at the portion where the ink flow space is formed. This provides the following merit.

9. The conductible ink quantity by the ink flow space is made larger than the ink quantity drawn by the ball in proportion to the ratio between the two diameters, and this makes the pen tip structure applicable to a pen for speed writing since it makes up for the drawn ink quantity greater than the ordinary case and thereby eliminates the trouble of intermittence in the writing due to shortage of ink conduction.

And the invention provides in the above described improved pen tip structure the ball retaining tube formed into substantially the same diameter as that of the ball up to the portion of the ink flow space except the drawn portion made for preventing the ball from getting out of place. This provides the following merit.

10. The pen tip whose diameter is similar to the diameter of the ball is furnished.

And the invention provides in the above described improved pen tip structure the cross section of the inner surface of the ball retaining tube and the cross section of the ball receiving stem formed in similar shapes to each other. This provides the following merit.

11. Substantially uniform capillary action is produced everywhere in the ink flow space since the gaps therein are substantially uniform and an excellent ink conducting performance is thereby provided.

And the invention provides in the above described improved pen tip structure the cross section of the inner surface of the ball retaining tube and the cross section of the ball receiving stem formed alike into a circular shape. This provides the following merit.

12. The gaps are uniformly distributed in the ink flow space and capillary action is uniform and steady in every portion, and so, the ink conducting function in the ink flow space is steadily performed.

And the invention provides in the above described improved pen tip structure the cross section of the inner surface of the ball retaining tube and the cross section of the ball receiving stem similarly formed into a square shape. This provides the following merit.

13. The bending strength of the pen tip is improved and therefore the pen tip does not bend under high writing-pressure and thus miniaturization of the pen tip is achieved.

And the invention provides in the above described improved pen tip structure the cross section of the inner surface of the ball retaining tube and the cross section of the ball receiving stem formed in different shapes from each other. This provides the following merit.

14. The ink flow space running in the axial direction is formed as that remained between the inner surface of the ball retaining tube and the surface of the ball receiving stem and therefore its manufacture is quite easy and a larger economical effect is obtained.

And the invention provides in the above described improved pen tip structure the cross section of the inner surface of the ball retaining tube formed into a circular shape and the cross section of the ball receiving stem formed into a square shape. This provides the following merits.

15. The ink flow space is formed as that remaining after the assembly work and therefore the manufacture is very easy and an economical effect is assured. And as the larger portion as practically possible in the ink flow space where the gaps are uniform is obtained, good ink conducting performance is thereby provided, and, further, the bending strength of the pen tip is improved.

And the invention provides in the above described improved pen tip structure the cross section of the inner surface of the ball retaining tube formed into a square shape and the cross section of the ball receiving stem formed into a circular shape. This provides the following merits.

16. The ink flow space is formed as that remaining after the assembly work and therefore the manufacture is quite easy and an economical effect is assured. And the pen tip is provided with much higher bending strength and capability of enduring a deeper pen angle.

And the invention provides in the above described improved pen tip structure a spiral groove axially running along the peripheral surface of the ball receiving stem at the portion where the ink flow space is formed. This provides the following merit.

17. The straight flow of a low-viscosity ink in the axial direction, or the drain back, is eliminated and excellent ink conducting performance especially with low-viscosity ink is provided.

And the invention provides in the above described improved pen tip structure concaved portions axially running along the peripheral surface of the ball receiving stem at the portion where the ink flow space is formed. This provides the following merit.

18. Good capillary action for high-viscosity ink is obtained and therefore makes this pen tip structure suited for high-viscosity ink.

And the invention provides in the above described improved pen tip structure the caulked portions formed into protruded stripes running in the axial direction. This provides the following merits.

19. The pen tip can be improved in its bending strength owing to the beam structure provided by the caulked portions and each of the blocks of the ink flow space divided by the caulked portions ensures capillarity in the axial direction and furnishes good ink conducting performance.

And the invention provides in the above described improved pen tip structure the caulked portion formed into a drawn or constricted shape running in the circumferential direction. This provides the following merit.

20. Capillary action both in the axial and circumferential directions are ensured and good ink conducting performance is provided.

And the invention provides in the above described improved pen tip structure the ball formed in a spherical shape. This provides the following merits.

21. The pen with this structure is not restricted in writing directions and pen angles and applicable to various uses such as for writing, drawing, and toilet purposes (putting on eye shadow, correcting eyebrows).

And the invention provides in the above described improved pen tip structure the ball formed in a roller. This provides the following merit.

22. The pen with this structure is excellent in drawing a straight line and a line with a constant width and therefore is suited for drawing purpose.

And the invention provides in the above described improved pen tip structure the ball retaining tube and ball receiving stem made of stainless steel and the ball made of stainless steel or ceramic. This provides the following merits.

23. The pen with this structure has high hardness and durability. The same is free from corrosion due to potential difference produced therein, or electrostatic action, and therefore free from the resulting rusting and defective ink flow due to clogging with rust, and thus the ink conducting performance is maintained unchanged.

And the invention provides in the above described improved pen tip structure the ball retaining tube made of stainless steel, the ball made of stainless steel or ceramic, and the ball receiving stem formed of a stainless steel-made stem portion with a synthetic resin film coated over its peripheral surface. This provides the following merits.

24. The pen with this structure has high hardness and durability, free from electrostatic action and the resultant troubles, securing unchanged ink conducting performance, and the wettability with ink on the peripheral surface of the ball receiving stem in the ink flow space is held at higher level and in steadier conditions.

And the invention provides in the above described invention pen tip structure the gap where capillarity takes place within the ink flow space in the thickness of approximately 25–100$\mu$. This provides the following merit.

25. Good capillary action is provided and the ink is steadily conducted in proper quantities to the ink flow path on the bottom of the ball retaining portion.

And the invention provides in the above described improved pen tip structure the ball retaining portion in the size of approximately 25–100$\mu$ in the width of its groove and approximately 100–20$\mu$ in the depth of the same. This provides the following merit.

26. Good capillary action is obtained and the ink conducted from the ink flow space is transferred to the ball in proper quantities.

BRIEF DESCRIPTION OF THE DRAWINGS

The accompanying drawings indicate examples of the pen tip structure according to the invention.

FIG. 1 is a vertical cross-sectional view.

FIG. 2 is a horizontal cross-sectional view taken along line II—II of FIG. 1.

FIG. 3 is a similar horizontal cross-sectional view showing an example with a different structure of the ink flow path.

FIGS. 4 to 11 are drawings exemplifying the pen tip structures which are all similarly arranged such that the cross-sectional shape of the inner surface of the ball retaining tube and the cross-sectional profile of the ball receiving stem are similar to each other and the ink flow paths are communicating with each other at the ball receiving surface portion but are different in the configurations of the ink flow paths, in which FIGS. 4, 6, 8, and 10 are vertical cross-sectional views, FIG. 5 is a horizontal cross-sectional view taken along line (5)—(5) of FIG. 4, FIG. 7 is a horizontal cross-sectional view taken along line (7)—(7) of FIG. 6, FIG. 9 is a horizontal cross-sectional view taken along line (9)—(9) of FIG. 8, and FIG. 11 is a horizontal cross-sectional view taken along line (11)—(11) of FIG. 10.

FIGS. 12 to 19 are drawings exemplifying the pen tip structures which are all similarly arranged such that the cross-sectional shape of the inner surface of the ball retaining tube and the cross-sectional profile of the ball receiving stem are similar to each other and the ink flow paths are in communication with each other and surrounding the ball receiving surface portion but are different in the configurations of the ink flow paths, in which FIGS. 12, 14, 16, and 18 are vertical cross-sectional views, FIG. 13 is a horizontal cross-sectional view taken along line (13)—(13) of FIG. 12, FIG. 15 is a horizontal cross-sectional view taken along line (15)—(15) of FIG. 14, FIG. 17 is a horizontal cross-sectional view taken along line (17)—(17) of FIG. 16, and FIG. 19 is a horizontal cross-sectional view taken along line (19)—(19) of FIG. 18.

FIGS. 20 to 30 are drawings exemplifying the pen tip structures which all likewise arranged such that the cross-sectional shape of the inner surface of the ball retaining tube is circular and the cross-sectional profile of the ball receiving stem is square but are different in the configurations of the ink flow paths, in which FIG. 20 is a vertical cross-sectional view, FIG. 21 is a horizontal cross-sectional view taken along line (21)—(21) of FIG. 20, FIG. 22 is a vertical cross-sectional view taken along line (22)—(22) of FIG. 21, FIG. 23 is a horizontal cross-sectional view taken along line (23)—(23) of FIG. 22, and FIGS. 24 to 30 are horizontal cross-sectional views.

FIGS. 36 to 38 are drawings showing a ballpoint pen as a concretely embodied example of the invention, in which FIG. 36 is a vertical cross-sectional front view, FIG. 37 is a horizontal cross-sectional plan view taken along line (37)—(37) of FIG. 36, and FIG. 38 is a horizontal cross-sectional plan view taken along line (38)—(38) of FIG. 36.

FIGS. 39 to 41 are drawings showing a pen tip for drawing purposes as another concretely embodied example of the invention, in which FIG. 39 is a vertical cross-sectional front view, FIG. 40 is a horizontal cross-sectional plan view taken along line (40)—(40) of FIG. 39, and FIG. 41 is a horizontal cross-sectional plan view taken along line (41)—(41) of FIG. 39.

FIGS. 43 to 45 are graphs showing ink extracting performance, in which FIG. 43 shows ink extracting performance by a pen tip structure without the ink flow path, FIG. 44 shows ink extracting performance by the pen tip structure according to the invention provided with the ink flow path of the arrangement as shown in FIG. 5, and FIG. 45 shows ink extracting performance by the pen tip structure according to the invention provided with the ink flow path of the arrangement as shown in FIG. 13.

DETAILED DESCRIPTION OF THE PREFERRED EMBODIMENTS

Figure 5:
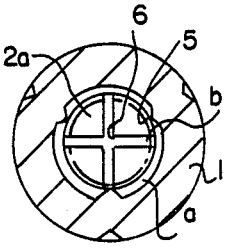
Figure 7:
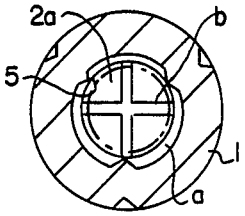
Figure 9:
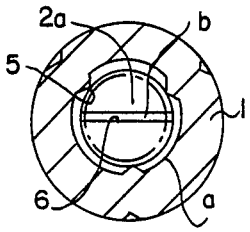
Figure 4:
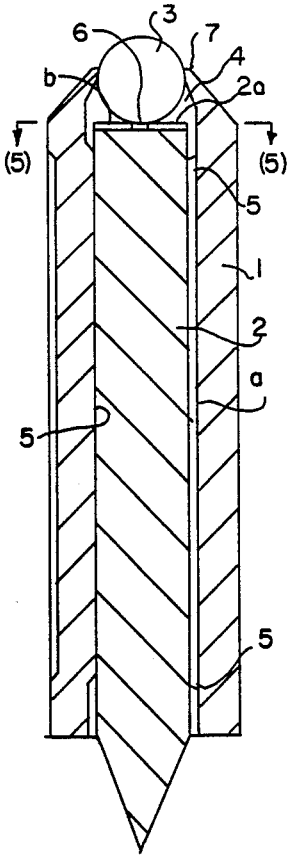

In order to clarify the present invention in further detail, description will be made referring to the accompanying drawings in the following.

FIGS. 1 to 3 exemplify the basic structure of the pen tip according to the present invention. The pen tip is made up of a ball retaining tube (1), a ball receiving stem (2) having ink flow paths (b) on its end surface portion (2*a*), and a rotatable member in the form of a ball (3).

The ball retaining tube (1) has a bore a little larger in diameter than the ball (3) and contains therein the ball receiving, elongated stem (2), which is of smaller diameter so that a gap is formed between the same and the inner surface of the tube, and the tube is caulked onto the stem from the outside at proper positions such that the tube is made integral with the stem and there is formed an ink flow path (a) axially running between the inner surface of the tube and the peripheral surface of the ball receiving stem (2), and within the tube at its end there is formed a ball retaining portion (4) having the end surface portion (2*a*) of the ball receiving stem (2) as its bottom and operably holding the ball (3) for rotation. The caulked portions (5) of the ball retaining tube (1) are made into protruded stripes uniformly projecting toward the center axis at equal intervals on the periphery of the ball receiving stem (2) starting at the vicinity of the end surface portion (2*a*) of the ball receiving stem (2) and ending at the position suitably separated therefrom in the axial direction, whereby the ball receiving stem (2) is uniformly pressed from the surroundings and good strength against bending, or rigidity, of the integrated body of the ball retaining tube (1) and ball receiving stem (2) is provided and, at the same time, the ink flow path (a) is formed in uniform thickness in axial and circumferential directions. The gap width in the ink flow path (a) will produce no problem if it is larger than 3–6μ when the thickness of the ink adhering to the surface being 3–4μ is taken into consideration, but 25–100 thick gap is given, in practice, subject to adjustment according to the properties of the materials used such as viscosity of the ink. When an oily ink is used, a somewhat larger gap is considered suitable.

The ball receiving stem (2) is of a solid stem structure and has a diameter such that the ink flow path (a) is formed between the same and the inner surface of the ball retaining tube (1), and the same is provided disposed on its end surface portion (2*a*) with groove-like ink flow paths (b) communicating with the ink flow space (a). The ink flow paths (b) are adapted to conduct the ink from the ink flow path (a) to the bottom of the ball retaining portion (4), i.e., the portion with which the ball rubs, or its vicinity, by capillary action. The ink flow paths (b), extended as far as the position of a ball receiving surface portion (6) in the center of the end surface portion (2*a*), or the vicinity of the ball receiving surface portion (6), is approximately 25–110μ in width of the groove and approximately more than 20μ, or preferably 40–100μ, in depth. Generally speaking, the width and the depth are inversely proportional to each other. The cross section of the ink flow path (b) takes various shapes, such as V-shape, U-shape, ⊔ shape, ⌣ shape, and so on.

The ball (3), prevented from getting out of place by the drawn portion (7) and provided at the end of the ball retaining tube (1), is received within the ball retaining portion (4) and adapted to draw the ink from the ink flow paths (b) as it rotates, being supported on the ball receiving surface portion (6). The diameter of the ball (3) is approximately 0.3 to 1.0 mm.

FIGS. 4 to 11 exemplify pen tip structures according to the invention in which the cross-sectional shape of the inner surface of the ball retaining tube (1) and the cross-sectional profile of the ball receiving stem (2) are all alike similar to each other and the ink flow paths (b) are similarly communicating with each other on the ball receiving surface portion (6) but are different in their configurations. These pen tips are all made up of three parts, that is, the ball retaining tube (1), the ball receiving stem (2) having, on its end surface portion (2*a*), a plurality of ink flow paths (b) communicating with each other reaching as far as the center of the ball receiving surface portion (6), and the ball (3), and the ball retaining tube (1) and the ball receiving stem (2) are arranged in the combination of a circular tube and a circular stem or of a square tube and a square stem.

The ball retaining tube (1) has a bore somewhat larger in diameter than the ball (3), contains therein the ball receiving stem (2) of a smaller diameter such that there may be provided a space between the same and the inner surface of the tube, and is inwardly caulked from outside the tube at proper positions such that the tube is pressed against the stem and made integral therewith and, at the same time, there is provided the ink flow space (a) axially running between the peripheral surface of the ball receiving stem (2) and the inner surface of the tube. The tube is provided with the ball retaining portion (4) within the same at its end having the end surface portion (2*a*) of the ball receiving stem (2) serving as the bottom and the ball retaining portion (4) operably retains the ball (3) for rotation. The caulked portions (5) of the ball retaining tube (1) are made into protruded stripes uniformly projecting toward the center axis at equal intervals on the periphery of the ball receiving stem (2) starting in the vicinity of the end surface portion (2*a*) of the ball receiving stem (2) and ending at the position suitably separated therefrom in the axial direction, whereby the ball receiving stem (2) is uniformly pressed from the surroundings and good strength against bending, or rigidity, of the integrated body of the ball retaining tube (1) and ball receiving stem (2) is provided and, at the same time, the ink flow space (a) is formed in uniform thickness axially and circumferentially. The gap width in the ink flow space (a) will produce no problem if it is larger than 3–6μ when the thickness of the ink adhering to the surface being 3–4μ is taken into consideration, but 25–100μ thick gap is given, in practice, subject to adjustment according to the properties of the materials used such as viscosity of the ink. When an oily ink is used, somewhat larger gap is considered suitable.

Figure 6:
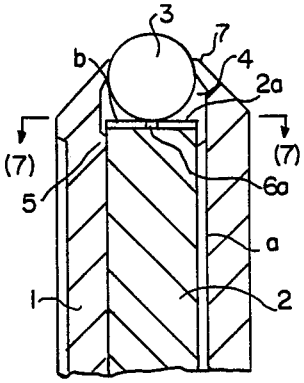
Figure 8:
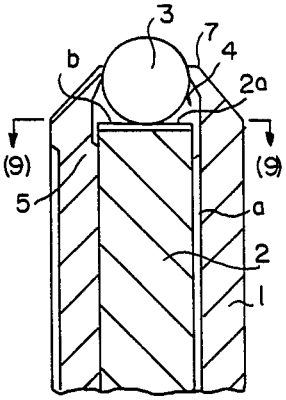

The ball receiving stem (2) is of a solid stem structure and has a diameter such that the ink flow space (a) is formed between the same and the inner surface of the ball retaining tube (1), and the end surface portion (2a) is provided thereon with the ink flow paths (b) in groove forms extending from the end portion of the ink flow space (a) centripetally to the center of the ball receiving surface portion (6) where they communicate with each other, whereby it is arranged that the ink is conducted by capillarity from the ink flow space (a) to the ball receiving surface portion (6), i.e., the portion where the ball rubs therewith, in the center of the end surface portion (2a). The ink flow paths (b) is provided in such a configuration that is easy to process, i.e., radially extended at equal angular intervals in four directions (FIG. 5), in two directions (FIG. 9), or in six directions (not shown). The groove width, preferably, is approximately 25–110μ and the depth is approximately over 20μ or, preferably, 40–100μ, where the groove width and the depth are generally inversely proportional to each other. And, the corner portion (6a) of the center portion, with which the ball (3) rubs, of the ink flow paths (b) may be made round so that the frictional resistance to the rotation of the ball (3) may be further decreased (FIG. 6).

The ball (3), prevented from getting out of place by the drawn portion (7) provided at the end of the ball retaining tube (1), is received within the ball retaining portion (4) and adapted to draw the ink from the center and its vicinity of the ink flow paths (b) as it rotates being supported by the ball receiving surface portion (6). Diameter of the ball 3 is approximately 0.3 to 1.0 mm.

Figure 10:
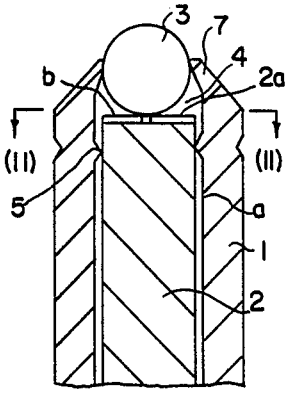
Figure 11:
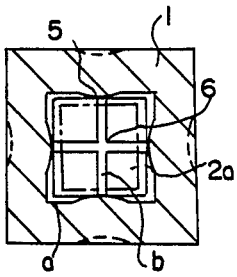
Figure 13:
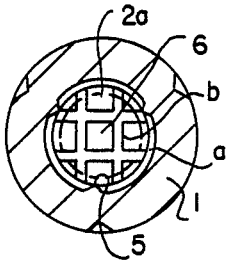

FIGS. 10 and 11 show an embodiment in which the ball (3) is formed into a roller and both the ball retaining tube (1) and ball receiving stem (2) are made square in their cross sections. In this embodiment, the width of the roller becomes the width of the written line.

FIGS. 12 to 19 exemplify pen tip structures according to the invention in which the cross-sectional shape of the inner surface of the ball retaining tube (1) and the cross-sectional profile of the ball receiving stem (2) are all alike similar to each other and the ink flow paths (b) in communication with each other are similarly arranged to surround the ball receiving surface portion (6) but are different in their configurations. These pen tips are all made up of three parts, that is, the ball retaining tube (1), the ball receiving stem (2) having, on its end surface portion (2a), the ink flow paths (b) reaching as far as the vicinity of the ball receiving surface portion (6) and arranged to be communicating with each other and surrounding the ball receiving surface portion (6), and the ball (3), and the ball retaining tube (1) and the ball receiving stem (2) are arranged in the combination of a circular tube and a circular stem or of a square tube and a square stem.

The ball retaining tube (1) has a bore somewhat larger in diameter than the ball (3), contains therein the ball receiving stem (2) of a smaller diameter such that there may be provided a space between the same and the inner surface of the tube, and is inwardly caulked from outside the tube at proper positions such that the tube is pressed against the stem to be made integral therewith and, at the same time, there is provided the ink flow space (a) axially running between the peripheral surface of the ball receiving stem (2) and the inner surface of the tube. The tube is provided with the ball retaining portion (4) within the same at its end having the end surface portion (2a) of the ball receiving stem (2) serving as the bottom. The ball retaining portion (4) operably retains the ball (3) for rotation. The caulked portions (5) of the ball retaining tube (1) are made into protruded stripes uniformly projecting toward the center axis at equal intervals on the periphery of the ball receiving stem (2) starting at the vicinity of the end surface portion (2a) of the ball receiving stem (2) and ending at the position suitably separated therefrom in the axial direction, whereby the ball receiving stem (2) is uniformly pressed from the surroundings and good strength against bending, or rigidity, of the integrated body of the ball retaining tube (1) and ball receiving stem (2) is provided and, at the same time, the ink flow space (a) is formed in uniform thickness axially and circumferentially. The gap width in the ink flow space (a) will produce no problem if it is larger than 3–6μ when the thickness of the ink adhering to the surface being 3–4μ is taken into consideration, but 25–100μ thick gap is given, in practice, subject to adjustment according to the properties of the materials used such as viscosity of the ink. When an oily ink is used, somewhat larger gap is considered suitable.

Figure 15:
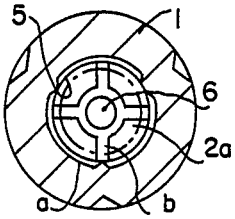
Figure 17:
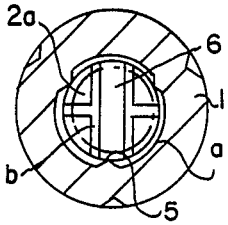
Figure 12:
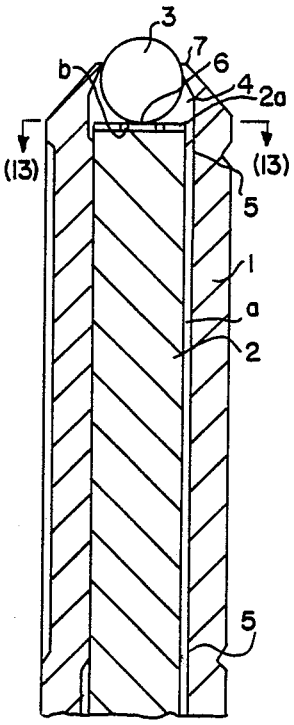
Figure 14:
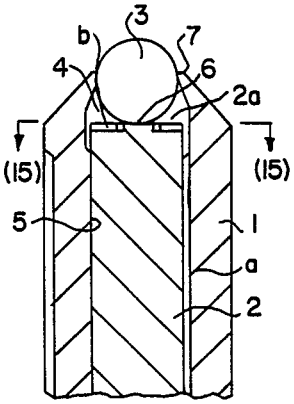
Figure 16:
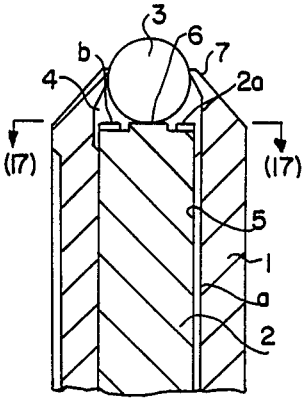
Figure 19:
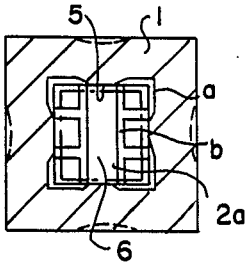
Figure 21:
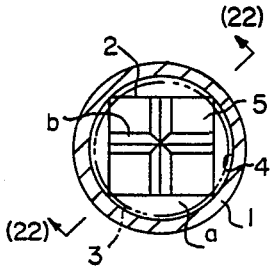
Figure 23:
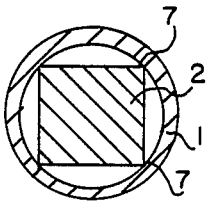
Figure 24:
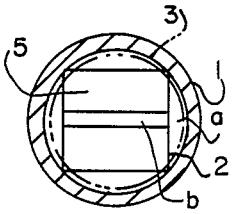
Figure 20:
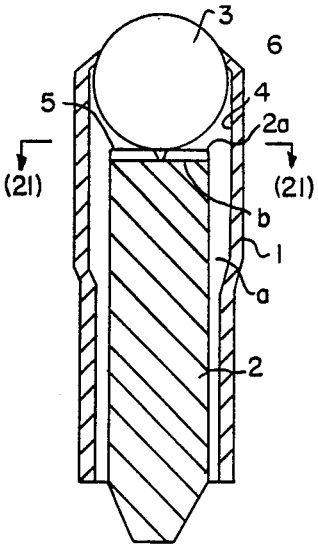
Figure 22:
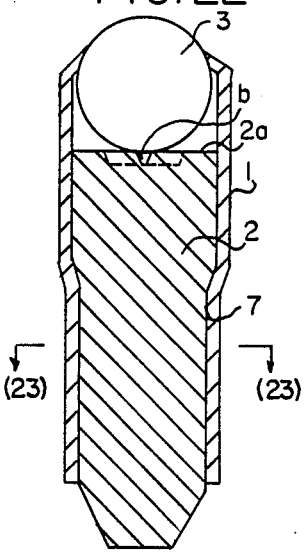
Figure 25:
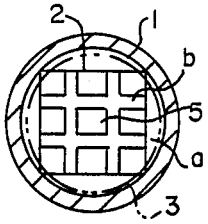
Figure 26:
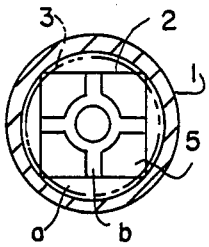
Figure 27:
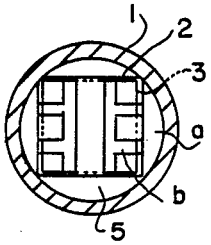
Figure 28:
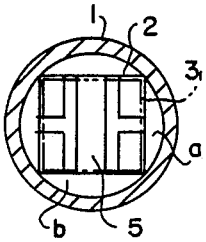
Figure 29:
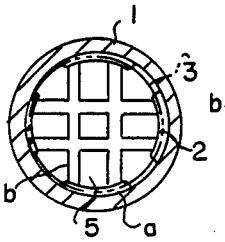
Figure 30:
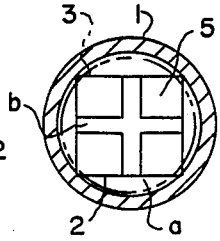

The ball receiving stem (2) is of a solid stem structure and has a diameter such that the ink flow space (a) is formed between the same and the inner surface of the ball retaining tube (1), and the same is provided with ball receiving surface portion (6) on its end surface portion (2a) and with the groove-like ink flow paths (b) communicating with the ink flow space (a) disposed on the surroundings of the ball receiving surface portion (6), whereby the ink is adapted to be conducted by capillarity from the ink flow space (a) to the surroundings of the ball receiving surface portion (6), i.e., the vicinity of the portion with which the ball rubs. The ink flow paths (b) consist of the flow path portion to surround the ball receiving surface portion (6) in such a configuration as parallel crosses (FIG. 13) or others as shown in FIGS. 15, 17, and 19, and the flow path portion communicating thence with the ink flow space (a). The groove width is approximately 25–110μ, and the depth is approximately 20μ or more, or, preferably, 40–100μ, and the groove width and depth are generally inversely proportional to each other. The ball receiving surface portion (6) being flat and smooth supports the ball (3) on a point. By the way, the ball receiving surface portion (6) may optionally be arranged in a slightly concaved form (FIG. 14).

The ball (3), prevented from getting out of place by the drawn portion (7) provided at the end of the ball retaining tube (1), is received within the ball retaining portion (4) and adapted to draw the ink from the ink flow paths (b) in the vicinity of the ball receiving surface portion (6) as it rotates being supported on a point on the ball receiving surface portion (6). Diameter of the ball (3) is approximately 0.3 to 1.0 mm.

Figure 18:
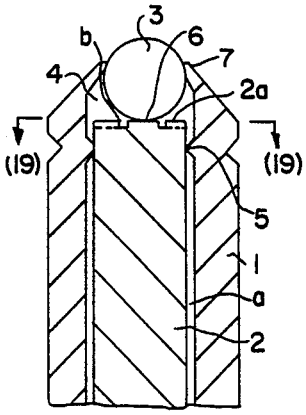

FIGS. 18 and 19 show an embodiment in which the ball (3) is formed into a roller and both the ball retaining tube (1) and ball receiving stem (2) are shaped square in their cross sections. This embodiment has a feature that the roller advances straight in writing and the width of the roller becomes the width of the written line. The caulked portions (5) are provided in a dotted arrangement.

FIGS. 20 to 30 exemplify pen tip structures according to the invention in which the cross-sectional shapes of the inner surfaces of the ball retaining tubes (1) are all alike circular and the cross-sectional profiles of the ball receiving stems (2) are likewise square but are different from each other in the configurations of the ink flow paths (b). These pen tips are all made up of three parts, i.e., the ball retaining tube (1) whose inner surface is circular in cross section, the ball receiving stem (2) whose cross-sectional profile is square and whose end surface portion (2*a*) is provided with the ink flow paths (b) reaching as far as the center or its vicinity of the ball receiving surface portion (6), and the ball (3).

The ball retaining tube (1) is circular in cross section and has a bore somewhat larger in diameter than the ball (3), containing therein the ball receiving stem (2) being square in cross section and having a diagonal width slightly larger than, equal to, or smaller than the bore of the tube, and is inwardly caulked from outside the tube at proper positions, the caulked portions (5), such that the tube is pressed against the stem to be made integral therewith and, at the same time, there is provided the ink flow space (a) axially running between the peripheral surface of the ball receiving stem (2) and the inner surface of the tube. The tube is provided with the ball retaining portion (4) within the same at its end having the end surface portion (2*a*) of the ball receiving stem (2) serving as the bottom. The ball retaining portion (4) operably retains the ball (3) for rotation.

The ball receiving stem (2) is of a stem structure being square in cross section and the ball receiving stem (2) is provided with the ball receiving surface portion (6) at its end surface portion (2*a*) and, on the ball receiving surface portion (6), provided with the groove-shaped ink flow paths (b) communicating with the ink flow space (a) and extended as far as the center or its vicinity of the ball receiving surface portion (6), whereby the ink is adapted to be guided from the ink flow space (a) to the ball receiving surface portion (6), the portion with which the ball rubs, or its vicinity by capillary action.

The ball (3), prevented from getting out of place by the drawn portion (7) provided at the end of the ball retaining tube (1), is received within the ball retaining portion (4) and adapted to draw the ink from the ball receiving surface portion (6) or the ink flow paths (b) at its vicinity as it rotates supported on the ball receiving surface portion (6). The ball is made into a sphere or a roller of approximately 0.3–1.0 mm in diameter.

The ink flow space (a) is formed of the space left between the inner surface of the ball retaining tube (1) in circular cross section and the peripheral surface of the ball receiving stem (2) in square cross section and running in the axial direction. The ink flow space (a), when the maximum thickness of the cross section of the ball receiving stem (2) is equal to or larger than the bore of the ball retaining tube (1) (FIG. 21 and FIGS. 24 to 29), is separated into divisions in number corresponding to the number of the faces of the ball receiving stem (2), and when the maximum thickness is smaller than the bore of the ball retaining tube (1) (FIG. 30), the divisions communicates with each other in the circumferential direction across the corners of the ball receiving stem (2). In either case, the ink flow space (a) is kept in communication with the ink flow paths (b) to supply the same with the ink and also to prevent the ink from being drained back. The gap width in the ink flow space (a) will produce no problem if it is larger than 3–6$\mu$ when the thickness of the ink adhering to the surface being 3–4$\mu$ is taken into consideration, but 25–100$\mu$ thick gap is given, in practice, subject to adjustment according to the properties of the materials used such as viscosity of the ink. When an oily ink is used, somewhat larger gap is considered suitable.

The ink flow paths (b) are extended as far as the center or the vicinity of the flat ball receiving surface portion (6) on the ball receiving stem (2) so as to communicate with each other, arranged in practice in various configurations such as a flat cross (FIGS. 21 and 30), parallel crosses (FIGS. 25 and 29), or something like that (FIG. 24, FIGS. 26 to 28), and are in communication with the ink flow space (a). The groove width is approximately 25–110$\mu$ and the depth is over 20$\mu$ or, preferably, 40–100$\mu$, and the groove width and depth are generally inversely proportional with each other.

Figure 31:
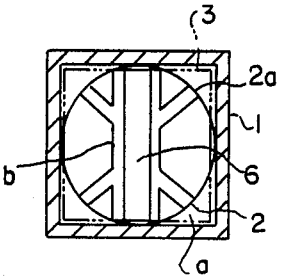
FIG. 31 is a horizontal cross-sectional view exemplifying a pen tip structure in which the cross-sectional shape of the inner surface of the ball retaining tube is square and the cross-sectional profile of the ball receiving stem is circular.

FIG. 31 exemplifies a structure of the pen tip according to the present invention in which the ball retaining tube (1) whose inner surface is square in cross section is combined with the ball receiving stem (2) whose cross-sectional profile is circular. In this case, the ball (3) is preferred to be of a roller type and then the ink flow paths (b) on the end surface portion (2*a*) are adapted to form the flow paths along the both sides of the ball retaining portion (4) in a line shape and thereby to allow the ink to be smoothly drawn by the ball from the flow paths.

Figure 32:
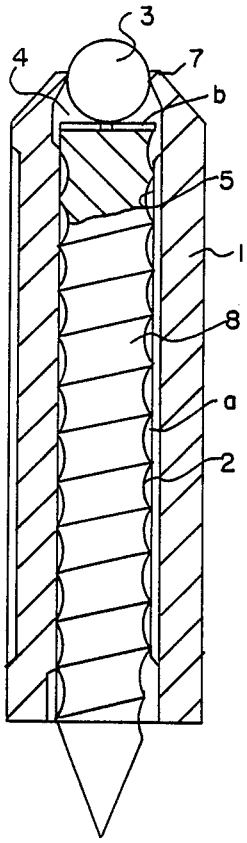
FIG. 32 is a partially cutaway front view exemplifying a pen tip structure in which the ball receiving stem is provided with a spiral groove disposed on its peripheral surface.

FIG. 32 exemplifies a structure of the pen tip according to the invention in which a spiral groove portion (8) is formed on the peripheral surface of the ball receiving stem (2), whereby the straight flow of the ink in the axial direction is restrained.

Figure 33:
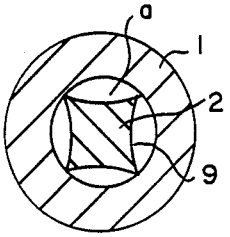
FIGS. 33 and 34 are horizontal cross-sectional views exemplifying pen tip structures in which the ball receiving stem is provided with concaved portions disposed on its peripheral surface.
Figure 34:
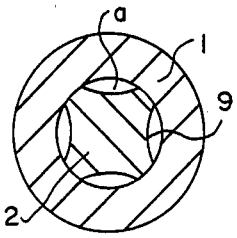

FIGS. 33 and 34 exemplify a structure of the pen tip according to the invention in which concaved portions (9) are formed on the peripheral surface of the ball receiving stem (2) in the axial direction, and the concaved portions (9) are suited for application to the arrangement in which the cross section of the inner surface of the ball retaining tube (1) is circular and the cross-sectional profile of the ball receiving stem (2) is square when an ink of high viscosity is used since the ink flow space is magnified by the concave.

Figure 35:
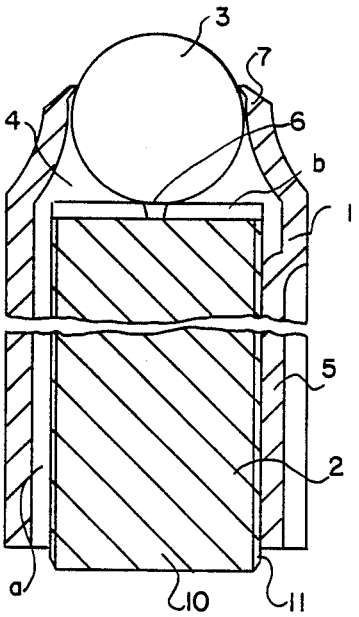
FIG. 35 is a vertical cross-sectional view exemplifying a pen tip structure in which the outer diameter of the ball receiving stem is made larger than the diameter of the ball.

FIG. 35 exemplifies a structure of the pen tip according to the invention in which the outer diameter of the ball receiving stem (2) is larger than that of the ball (3). The ball receiving stem (2) of this structure has a feature to enlarge the annular ink flow space (a) and thereby to enhance the ink conducting performance in proportion to the diameter by providing increased flow space without increasing the size of the gap.

In the case of the pen tip according to the invention where the three parts are formed of special materials such that the ball retaining tube (1) and ball receiving stem (2) are formed of stainless steel and the ball (3) is formed of stainless steel or ceramic, there is not occurring any electrostatic action among these three members and therefore there is not produced any corrosion or rusting due to such action. The same may be said with the arrangement in which the ball receiving stem (2) is formed of a stainless steel stem portion (10) with a synthetic resin film (11) coated thereover. In either case, durability characteristic of these hard materials is provided.

Figure 37:
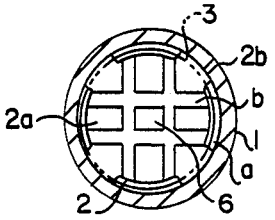
Figure 36:
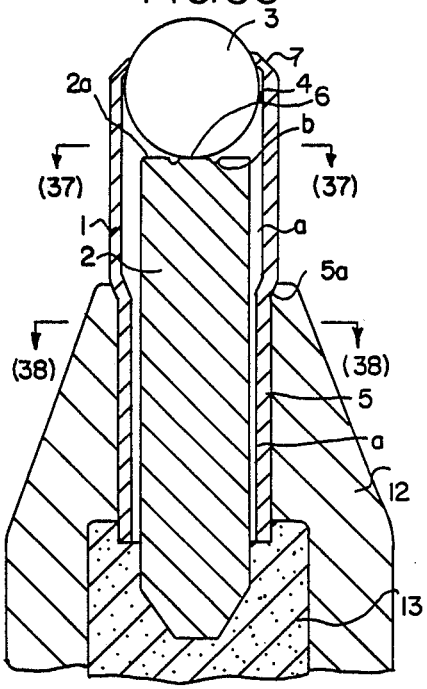
Figure 38:
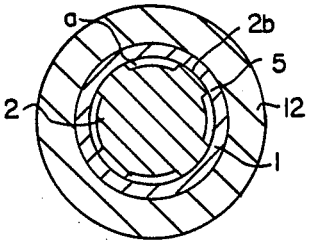

FIGS. 36 to 38 indicate the pen tip structure according to the invention when concretely embodied in a ballpoint pen.

The pen tip is structured such that a ball receiving stem (2) whose cross-sectional profile is square is inserted in a ball retaining tube (1) whose cross-sectional shape is circular and the lower half of the ball retaining tube (1) is caulked so as to be reduced in diameter and pressed against the ball receiving stem (2) at chamfered corner portions (2*b*) thereby to be made integral therewith, and the space between the inner surface of the ball retaining tube (1) and the peripheral surface of the ball receiving stem (2) running in the axial direction is made into the ink flow space (a). And, ink flow paths (b) are disposed substantially in a parallel-cross configuration on a flat ball receiving surface portion (6) serving as the bottom of the ball retaining portion (4) of the pen tip. The spherical ball (3) is supported on the flat surface on a point so that the same may sufficiently endure impulsive writing-pressure and high writing-pressure and the ink may be forcedly supplied very close to the point of support by capillary action.

The caulked portion (5) is tightly fitted into a pen tip holder (12) as far as the jaw portion of the caulked portions (5) serving as the stopper (5*a*) is caught by the end of the pen tip holder, while the ball receiving stem (2) is inserted into an ink reservoir (13), whereby the ink is fed through the ink flow space (a) and the ink flow paths (b) to the ball (3).

Figure 40:
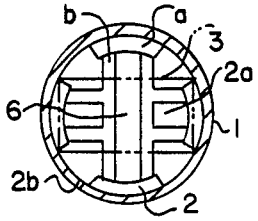
Figure 39:
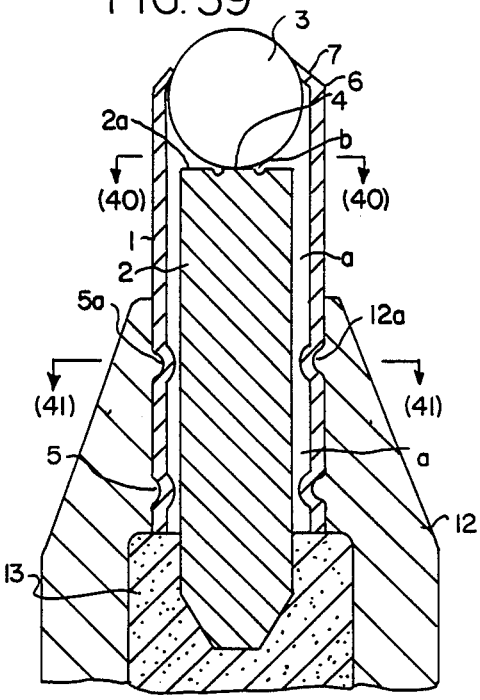
Figure 41:
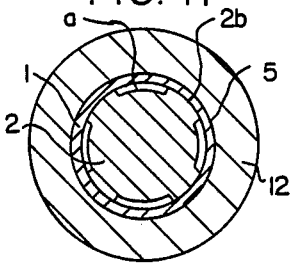

FIGS. 39 to 41 indicates a ballpoint pen for drawing purposes as another concrete embodiment of the invention.

The pen tip is structured such that a ball receiving stem (2) whose cross-sectional profile is square is inserted in a ball retaining tube (1) whose cross-sectional shape is circular and the same is caulked so as to be constricted in the middle and at the lower portion and pressed against the ball receiving stem (2) at chamfered corner portions (2*b*) thereby to be integrated therewith, and the space between the inner surface of the ball retaining tube (1) and the surface of the ball receiving stem (2) running in the axial direction is made into the ink flow space (a). And the ink flow paths (b) are disposed in a substantially ⊐⊨-like configuration on a flat ball receiving surface portion (6) serving as the bottom of the ball retaining portion (4) of the pen tip and a roller type ball (3) is supported on the flat surface on a line so that the ball may fully endure impulsive writing-pressure and high writing-pressure and the ink may be forcedly supplied very close to the support line by capillarity.

The caulked portions (5) are tightly fitted into a pen tip holder (12) as far as the constricted portions thereof serving as engagement recess (5*a*) are put in engagement with annular protrusions (12*a*) provided in the pen tip holder, while the ball receiving stem (2) is inserted into an ink reservoir (13), whereby the ink is fed through the ink flow space (a) and the ink flow paths (b) to the ball (3).

In both the above mentioned embodiments, the caulked portions (5) perform two functions, i.e., to fixedly integrate the ball retaining tube (1) with the ball receiving stem (2) and to fixedly connect itself with the pen tip holder (12), and since the caulked portions (5) is pressed against the ball receiving stem (2) at its chamfered corner portions (2*b*), these members can be integrated in a condition tightly fixed together between faces. And, since the roller width of the ball (3) becomes the width of a drawn line and various widths of lines can be drawn with various widths of rollers, the arrangement provides convenience in drawing.

A roller type ball (3) made of flexible synthetic resin will be suited for toilet purposes.

Figure 42:
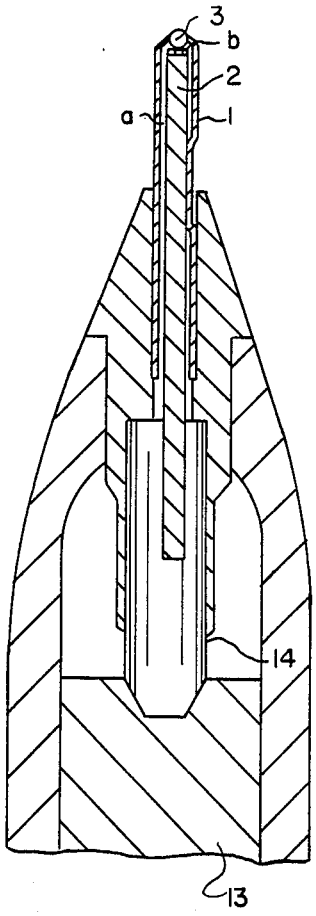
FIG. 42 is a vertical cross-sectional view showing another concrete embodiment.

FIG. 42 shows another embodiment, in which an intermediate conducting core (14) formed of a bundle of fibers is interposed between the ink flow space (a) in the pen tip and the ink reservoir (13). By means of the intermediate conducting core (14) as the junction path between the path of the ink flow space (a) and the ink reservoir (13), the ink "sucking up" action by the ink reservoir (13) is minimized, and it is adapted, even when the ink quantity in the ink reservoir (13) becomes very small, such that the ink is smoothly conducted by capillarity through the intermediate core (14) and the ink flow space (a) to the ink flow paths (b) to be extracted therefrom by the ball (3).

Figure 43:
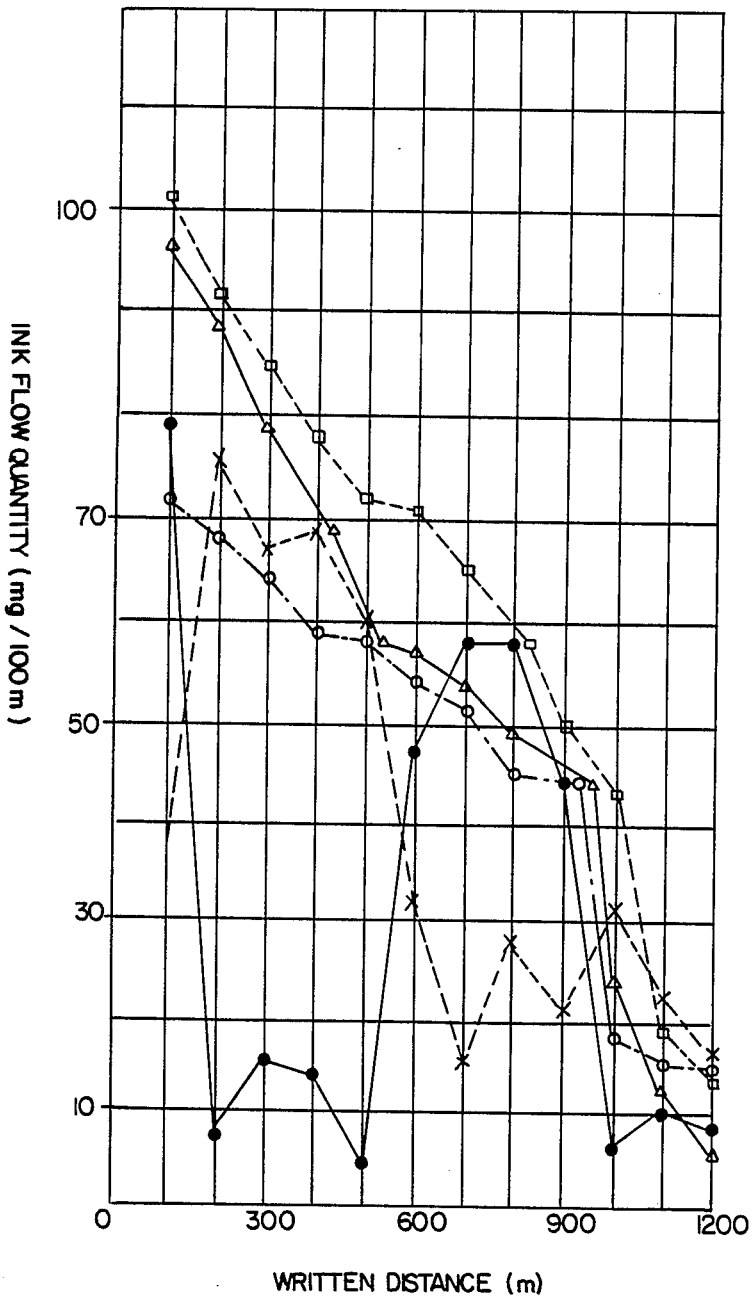
Figure 44:
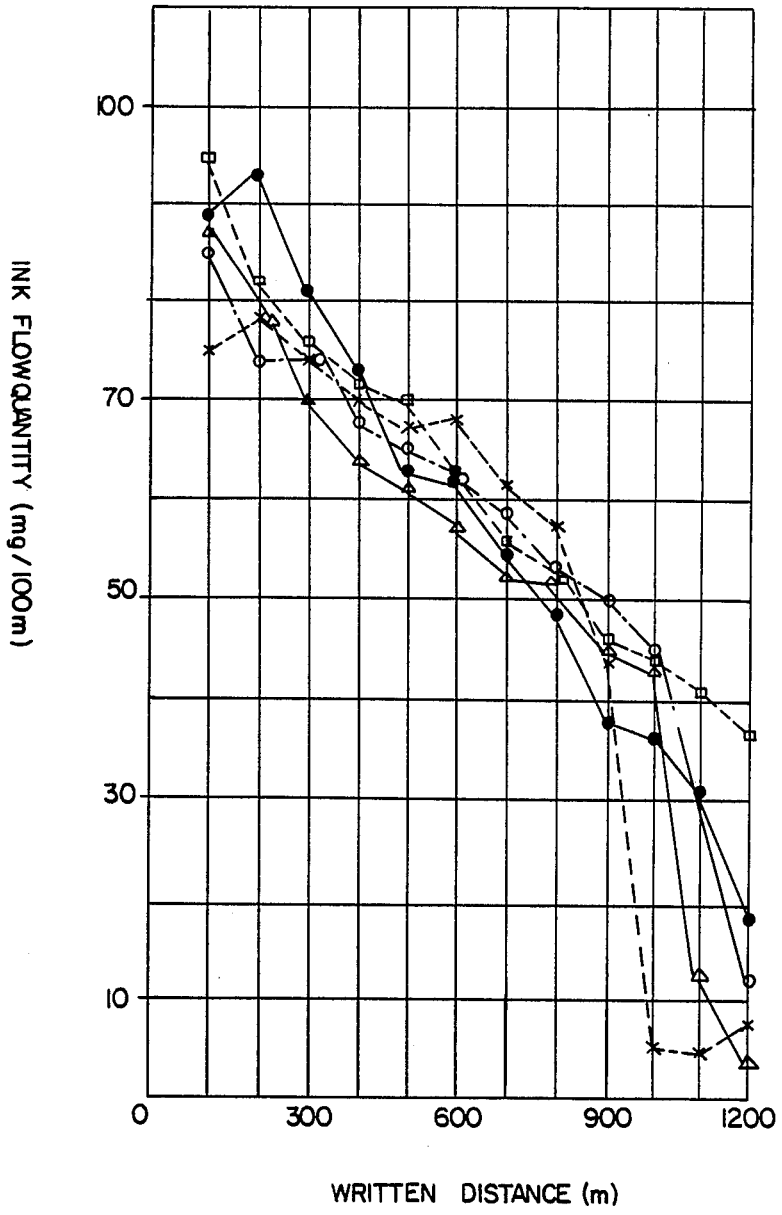
Figure 45:
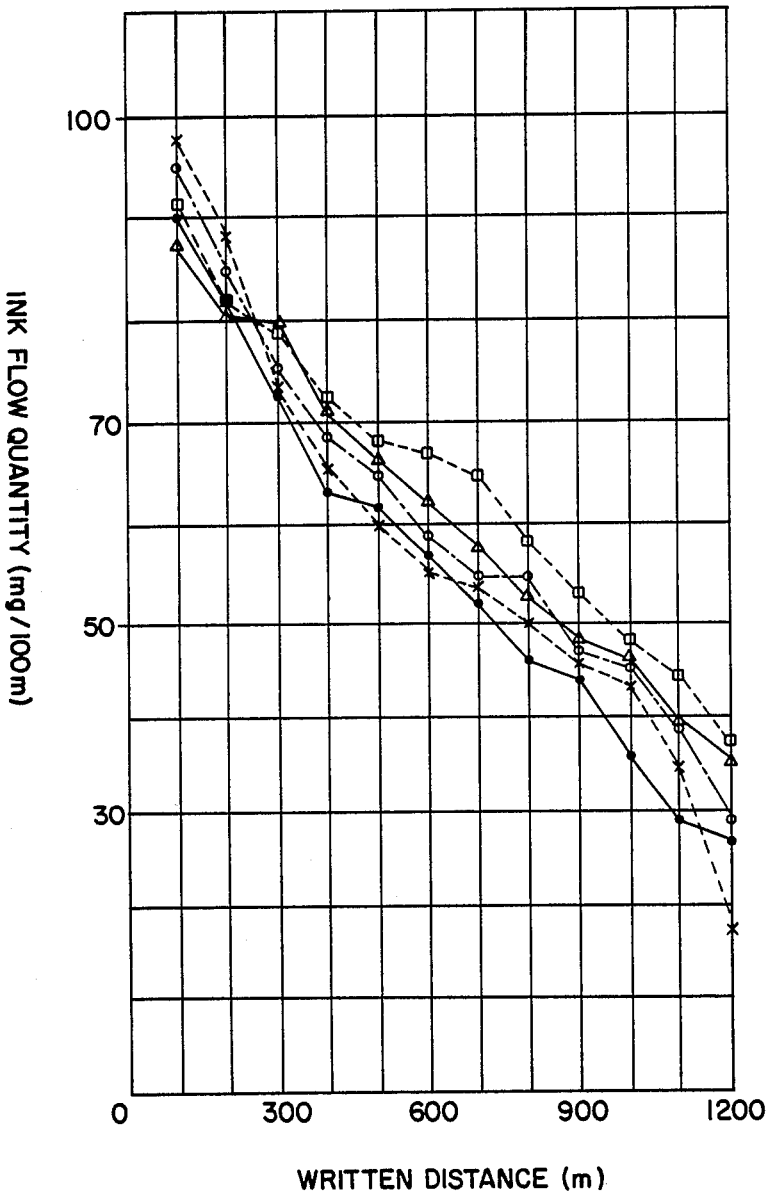

FIGS. 43 to 45 show data on the ink extracting performance of the pen tips, i.e., the data of the pen tips which are not provided with the ink flow paths (b) of the invention (FIG. 43) and the data of the pen tips provided with the ink flow paths (b) of the invention (FIGS. 44 and 45). These data were all obtained through the tests made on five random samples of pen tips.

As apparent from these data, the pen tip structures without the ink flow paths (b) of the invention exhibited very wide dispersion and instability in the ink extracting performance, while the pen tip structures with the ink flow paths (b) of the invention showed almost unnoticeable dispersion and proved their stability in the ink extracting performance. Thus it is understood that they are quite reliable when applied to the products for practical uses.

INDUSTRIAL APPLICABILITY

As described in the foregoing, the pen tip structure according to the present invention is useful as the pen tips for ballpoint pens for writing, drawing, and toilet purposes and the same is especially suited for the applications requiring smooth and reliable ball rotation, stable ink extracting performance, and durability against high writing-pressure.

What is claimed is:

1. A pen tip structure which comprises an elongated stem defining a cylindrical outer surface and a flat end surface, a tube positioned around said elongated stem, said tube defining an inner surface and an end portion located beyond said flat end surface of said elongated stem, said inner surface including a plurality of inwardly-extending protrusions that contact the cylindrical outer surface of said elongated stem to form a plurality of straight, longitudinal ink flow channels between the cylindrical outer surface of said elongated stem and the inner surface of said tube, said longitudinal ink flow channels functioning to convey ink from an ink reservoir to said flat end surface of said elongated stem, said end portion of said tube forming a mouth for retaining a rotatable member between said mouth and the flat end surface of said elongated stem, and a rotatable member positioned between said mouth of said tube and the flat end surface of said elongated stem, said rotatable member having a surface, a first portion of said surface extending beyond said mouth of said tube and an opposite, second portion of said surface being located adjacent a center point of the flat end surface of said elongated stem and in rubbing contact with said flat end surface of said elongated stem, and wherein said flat end surface of said elongated stem has an elongated groove therein which extends from said cylindrical outer surface radially inwardly toward and proximate to said center point of said flat end surface, said elongated groove communicating with at least one of said longitudinal ink flow channels and extending generally perpendicularly to said straight ink flow channels to define an additional ink flow channel for conveying ink from said longitudinal ink flow channels towards said center point of said flat end surface of said elongated stem, said longitudinal ink flow channels and said elongated groove being dimensioned such that, when said pen tip structure is oriented such that said rotatable member is positioned beneath said elongated stem, ink is conveyed from an ink reservoir by capillary action along said longitudinal ink flow channels and said elongated groove in said flat end surface of said elongated stem without inadvertent escape therefrom, whereas when said pen tip structure is oriented such that said rotatable member is positioned above said elongated stem, capillary action will cause ink to remain within said elongated groove and said longitudinal ink flow channels and in contact with said second portion of said surface of said rotatable member.

2. A pen tip structure according to claim 1, including a plurality of elongated grooves extending radially inwardly from said cylindrical outer surface, said plurality of grooves communicating with each other near said center point of said flat end surface of said elongated stem.

3. A pen tip structure according to claim 1, wherein said tube is made of stainless steel, said elongated stem is formed of a stainless steel stem portion having a synthetic resin film (1) coated over its peripheral surface, and said rotatable member is made of stainless steel or ceramic.

4. The pen tip structure according to claim 1, wherein said elongated groove extends from the cylindrical outer surface of said elongated stem to the center point of the flat end surface thereof.

5. A pen tip structure according to claim 4, including a plurality of elongated grooves extending radially inwardly from said cylindrical outer surface, said plurality of grooves communicating with each other at the center point of said flat end surface of said elongated stem.

6. The pen tip structure according to claim 1, wherein said rotatable member consists of a ball.

7. The pen tip structure according to claim 6, wherein the diameter of said ball is smaller than the diameter of said elongated stem.

8. The pen tip structure according to claim 1, wherein the inner surface of said tube is cylindrical.

9. The pen tip structure according to claim 8, wherein the radial spacing between the cylindrical outer surface of said elongated stem and the cylindrical inner surface of said tube is 25 to 100$\mu$.

10. The pen tip structure according to claim 1, wherein each of said elongated stem, said tube and said rotatable member are composed of stainless steel.

11. The pen tip structure according to claim 1, wherein said elongated stem and said tube are composed of stainless steel and said rotatable member is composed of ceramic.

12. The pen tip structure according to claim 1, wherein said groove has a rectangular cross section.

13. The pen tip structure according to claim 1, wherein said groove has a width of between 25 and 110$\mu$ and a depth of between 100 and 20$\mu$.

14. The pen tip structure according to claim 1, wherein said inwardly-extending protrusions extend axially of said tube.

15. The pen tip structure according to claim 1, wherein said inwardly-extending protrusions are equally spaced apart around the inner surface of said tube.

16. The pen tip structure according to claim 15, wherein said tube includes three inwardly-extending protrusions on the inner surface thereof.

* * * * *